US008961242B2

(12) United States Patent
Kim et al.

(10) Patent No.: US 8,961,242 B2
(45) Date of Patent: Feb. 24, 2015

(54) CONNECTION PLUG FOR PORTABLE TERMINAL

(71) Applicant: Tyco Electronics AMP Korea Ltd., Kyungsangbuk-Do (KR)

(72) Inventors: Jung-Hoon Kim, Seoul (KR); Jeong-Han Gong, Seoul (KR)

(73) Assignee: Tyco Electronics AMP Korea Ltd., Kyungsangbuk-Do (KR)

( * ) Notice: Subject to any disclaimer, the term of this patent is extended or adjusted under 35 U.S.C. 154(b) by 98 days.

(21) Appl. No.: 13/686,287

(22) Filed: Nov. 27, 2012

(65) Prior Publication Data

US 2013/0149915 A1 Jun. 13, 2013

(30) Foreign Application Priority Data

Nov. 28, 2011 (KR) ..... 10-2011-0125252

(51) Int. Cl.

| | |
|---|---|
| ***H01R 13/04*** | (2006.01) |
| ***H01R 12/72*** | (2011.01) |
| ***H01R 27/00*** | (2006.01) |
| *H01R 24/28* | (2011.01) |
| *H01R 13/05* | (2006.01) |
| *H01R 107/00* | (2006.01) |

(52) U.S. Cl.

CPC ..... *H01R 13/04* (2013.01); *H01R 12/724* (2013.01); *H01R 27/00* (2013.01); *H01R 24/28* (2013.01); *H01R 13/055* (2013.01); *H01R 2107/00* (2013.01); *Y10S 439/9241* (2013.01)

USPC ..... 439/692; 439/60; 439/924.1

(58) Field of Classification Search

USPC ..... 439/692, 660, 60, 924.1, 954

See application file for complete search history.

(56) References Cited

U.S. PATENT DOCUMENTS

| | | | | |
|---|---|---|---|---|
| 6,435,912 | B1 * | 8/2002 | Zhu et al. | 439/607.23 |
| 6,755,689 | B2 * | 6/2004 | Zhang et al. | 439/607.01 |
| 6,945,824 | B1 * | 9/2005 | Li et al. | 439/660 |
| 7,402,084 | B2 * | 7/2008 | Wu | 439/660 |
| 7,563,140 | B1 * | 7/2009 | Wan et al. | 439/660 |
| 7,572,146 | B1 * | 8/2009 | Chiang | 439/607.01 |
| 7,695,318 | B1 * | 4/2010 | Wang et al. | 439/607.01 |
| 7,727,026 | B2 * | 6/2010 | Qin et al. | 439/660 |
| 7,824,222 | B2 * | 11/2010 | Miyoshi et al. | 439/607.41 |
| 7,887,370 | B2 * | 2/2011 | Chen et al. | 439/607.35 |
| 8,133,079 | B2 * | 3/2012 | He | 439/660 |
| 8,708,718 | B2 * | 4/2014 | Li et al. | 439/108 |
| 2011/0009008 | A1 * | 1/2011 | Wang | 439/660 |
| 2012/0231643 | A1 | 9/2012 | Kim | |

* cited by examiner

*Primary Examiner* — Neil Abrams
*Assistant Examiner* — Travis Chambers
(74) *Attorney, Agent, or Firm* — Barley Snyder

(57) ABSTRACT

A connection plug for a portable terminal includes a plurality of plug connection terminals of different types disposed on one plane in a case and connected with socket connection terminals mounted to a socket. Here, ends of the plurality of plug connection terminals to be connected with the socket connection terminals are disposed in different positions. The plurality of plug connection terminals are in different lengths. Accordingly, since different types of plug connection terminals of the connection plug are mounted on one plane such that the ends of the plug connection terminals are disposed in different positions, thickness of the connection plug may be minimized. Also, different functions may be performed with one connection plug. In addition, since different plug connection terminals are in different lengths, connection between the respective connection terminals may be stably achieved when the connection plug is inserted in the socket.

16 Claims, 7 Drawing Sheets

PRIOR ART

CONNECTION PLUG FOR PORTABLE TERMINAL

CROSS-REFERENCE TO RELATED APPLICATION

This application claims the benefit of Korean Patent Application No. 10-2011-0125252, filed on Nov. 28, 2011, in the Korean Intellectual Property Office, the disclosure of which is incorporated herein by reference.

BACKGROUND

The present invention relates to a connection plug for a portable terminal, and more particularly, to a connection plug for a portable terminal, configured such that at least two types of plug connection terminals are disposed on a same plane, thereby providing two types of connection plugs, and reduced in the overall thickness.

Generally, a portable terminal is equipped with functions including not only voice call but also video call, input and output of information, data storage, Internet communication, and the like.

Recently, such functions are more diversified and various contents are applied through the portable terminal. Accordingly, the portable terminal is equipped with complex functions including not only phone calling but also personal information and credit payment, photo and video taking, music and video playing, game, broadcasting reception, and the like. Also, a multimedia device may be implemented by combining those functions.

Due to the various additional functions, the portable terminal is provided with various types of connection modules corresponding to necessary sockets. The sockets and the connection modules may include a universal serial bus (USB) port for taking data in and out of a mobile communication terminal as desired by a user, and an input and output port for connection of an input and output device interfacing signals of an earphone, a remote controller, a television (TV), and the like.

Referring to FIG. 5 that shows a conventional connection plug for a portable terminal that connects various types of input and output ports to a connection socket through one connection plug, a step 2 is formed in a case 1 so that different types of plug connection terminals 3 and 4 may connect with the connection socket without interfering with each other. The plug connection terminals 3 and 4 are arranged separately and alternately at an upper portion and a lower portion of the step 2 so that the respective plug connection terminals function as different connection plugs.

In addition, any one of the different plug connection terminals 3 and 4, for example the plug connection terminal 4, may be a movable terminal configured to move down while the connection plug is inserted in the connection socket and connected with a connection terminal of the connection socket.

Therefore, when the connection plug is inserted in the connection socket, the connection terminal of the connection socket may be connected with the plug connection terminal 4 disposed at the upper portion or the plug connection terminal 3 disposed at the lower portion of the case 1 with respect to the step 2. Therefore, individual plug connection terminals may function as one port. That is, one connection plug may perform functions of two types of ports.

SUMMARY

A conventional connection plug as described above was designed to solve inconvenience of preparing various types of plugs having different functions. However, since different types of connection plugs form a step and are arranged at an upper portion and a lower portion with respect to the step in one case, it becomes difficult to manufacture a slim portable terminal according to a tendency.

In addition, in the conventional connection plug, since one of plug connection terminals is implemented by a movable terminal, the movable terminal as the plug connection terminal needs to be connected after another plug connection terminal is insert-molded in the case. Therefore, manufacturing of the socket is complicated.

Accordingly, to solve the foregoing limits, an aspect of the present invention provides a connection plug for a portable terminal, in which different types of plug connection terminals are mounted in one case and arranged on one plane, to minimize an entire thickness.

In particular, another aspect of the present invention is in that different types of plug connection terminals arranged on one plane are connected with connection terminals of a socket in different positions.

Still another aspect of the present invention is in that different types of connection terminals arranged on one plane do not interfere with each other.

Yet another aspect of the present invention is to provide a circuit board connected with the plug connection terminals.

Further, another aspect of the present invention is to guide an insertion position of a plug with respect to a socket.

According to an aspect of the present invention, there is provided a connection plug for a portable terminal, including a plurality of plug connection terminals of different types disposed on one plane in a case and inserted in a socket in which connection terminals for connection with the plurality of plug connection terminals are mounted, wherein ends of the plurality of plug connection terminals to be connected with the connection terminals of the socket are disposed in different positions.

The plurality of plug connection terminals may be in different lengths.

The case may include a mounting case including a first mounting portion and a second mounting portion formed corresponding to the lengths of the plurality of plug connection terminals, and a third mounting portion extended to rear ends of the first mounting portion and the second mounting portion; and a cover case configured to protect the plurality of plug connection terminals by enclosing the mounting case and to be coupled with the mounting case by the third mounting portion.

The plurality of plug connection terminals may include first plug connection terminals mounted at the first mounting portion; and second plug connection terminals mounted at the second mounting portion, wherein the first plug connection terminals are longer than the second plug connection terminals.

The first plug connection terminals may be disposed along both sides of the second plug connection terminals.

The third mounting portion may include board mounting recesses to insert both ends of a circuit board connected with the plurality of plug connection terminals passing through the third mounting portion.

The socket may include a plug stopper to restrict an insertion length of the cover case with respect to the socket, and the cover case may include a stopper insertion hole to insert the plug stopper and restrict the insertion length of the cover case with respect to the socket as the plug stopper contacts the cover case.

The stopper insertion hole may be formed having a length corresponding to a length for the case to be inserted in the socket so that the plurality of plug connection terminals are respectively connected to the connection terminals of the socket.

The cover case may include a fixing projection that protrudes upward from an upper surface of the cover case so that the fixing projection contacts an inner surface of the socket when inserted in the socket.

The connection plug may be engaged with the socket by the plurality of plug connection terminals, the socket including the connection terminals arranged on one plane.

According to embodiments of the present invention, different types of plug connection terminals of a connection plug are mounted on one plane in such a manner that ends of the individual plug connection terminals are disposed in different positions. Therefore, while thickness of the connection plug is minimized, different functions may be performed with one connection plug.

In particular, since the different types of the plug connection terminals of the connection plug have different lengths, connection positions between the plug connection terminals and connection terminals of the socket are different. Therefore, when the connection plug is inserted in the socket, the respective terminals may be stably connected.

In addition, according to embodiments of the present invention, since a board mounting recess for mounting of a circuit board to a mounting case of the connection plug is provided, the plug connection terminals may be mounted to the mounting case without a separate method or unit while simultaneously being connected with the circuit board.

According to embodiments of the present invention, a stopper insertion hole is provided to the connection plug, the stopper insertion hole which guides an insertion length of the connection plug with respect to the socket. Therefore, interference between different connection terminals or connection defects that may be caused when the connection plug is excessively or insufficiently inserted in the socket may be prevented.

Furthermore, according to embodiments of the present invention, a fixing projection is provided to the connection plug. Therefore, when the connection plug is inserted in the socket, a gap between the connection plug and the socket may be minimized by the fixing projection. As a result, unwanted escape of the connection plug from the socket may be prevented.

BRIEF DESCRIPTION OF THE DRAWINGS

These and/or other aspects, features, and advantages of the invention will become apparent and more readily appreciated from the following description of exemplary embodiments, taken in conjunction with the accompanying drawings of which.

DETAILED DESCRIPTION

Figure 1:
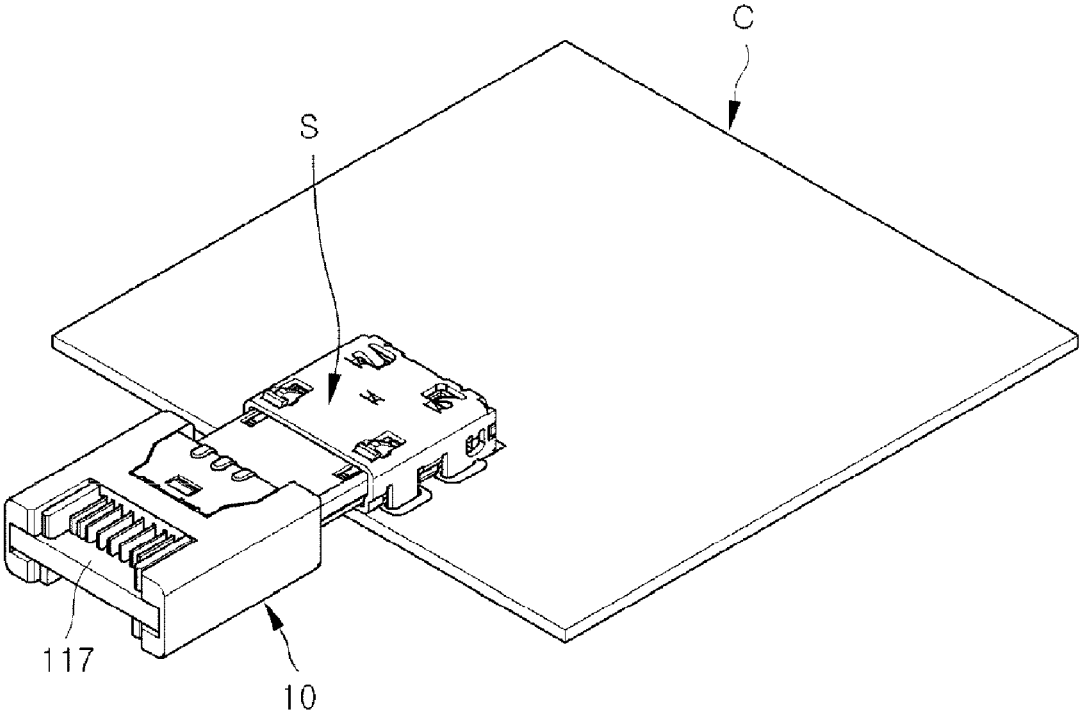
FIG. 1 is a diagram illustrating a state in which a connection plug for a portable terminal is inserted in a socket, according to the present invention.

Reference will now be made in detail to a card mounting socket for a portable terminal according to exemplary embodiments of the present invention, examples of which are illustrated in the accompanying drawings, wherein like reference numerals refer to the like elements throughout.

Figure 2:
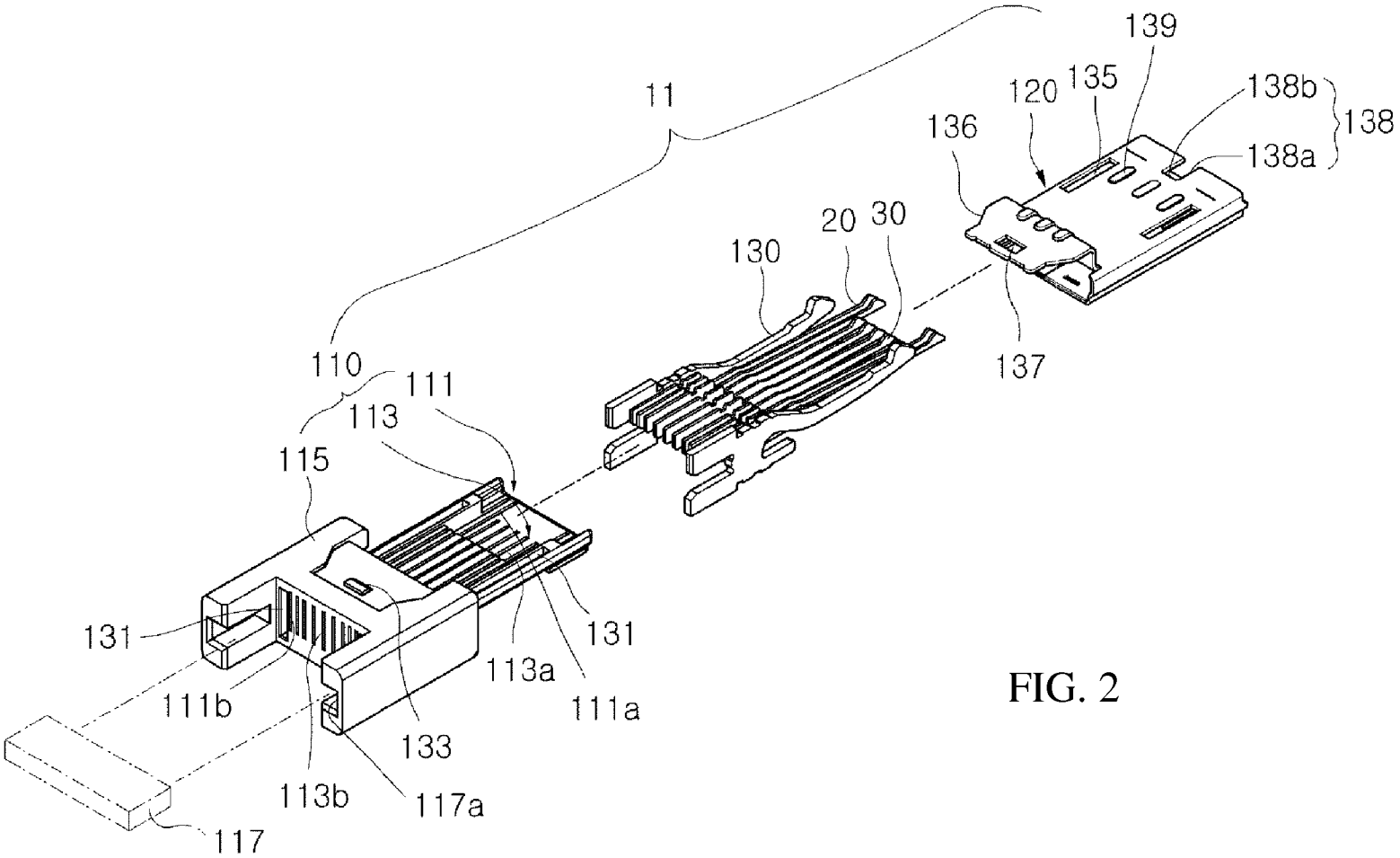
FIG. 2 is an exploded perspective view of the connection plug for a portable terminal according to the present invention.
Figure 3:
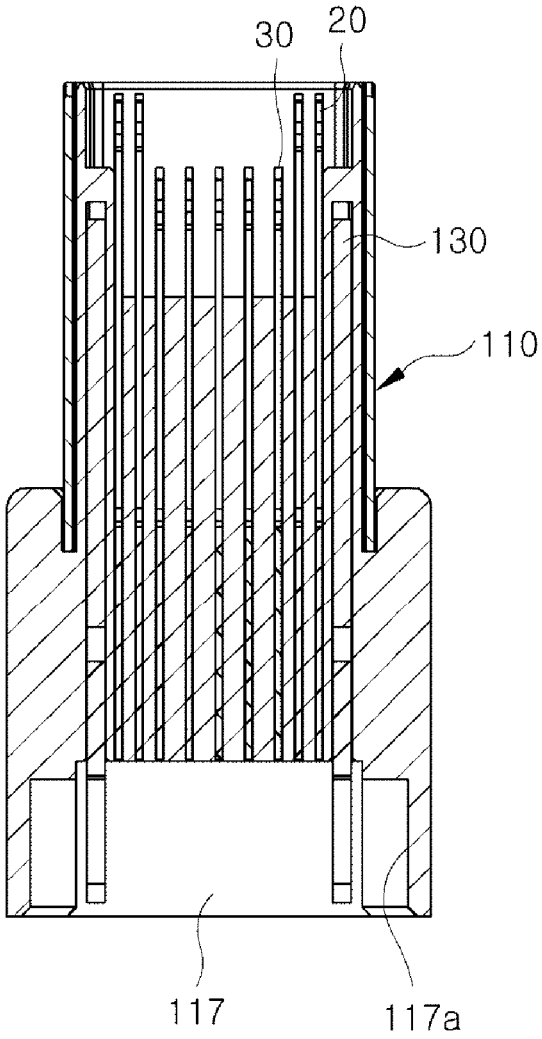
FIG. 3 is a diagram illustrating a mounting state of a first connection terminal and a second connection terminal of the connection plug for a portable terminal, according to the present invention.

FIG. 1 is a diagram illustrating a state in which a connection plug 10 for a portable terminal is inserted in a socket S, according to the present invention. FIG. 2 is an exploded perspective view of the terminal plug 10 for a portable terminal according to the present invention. FIG. 3 is a diagram illustrating a mounting state of a first connection terminal and a second connection terminal of the connection plug 10 for a portable terminal, according to the present invention.

As shown in the drawings, the connection plug 10 refers to an input and output port for transmitting data or signals by being inserted in the socket S installed at a circuit board C. Since different types of plug connection terminals are mounted on one plane in one case, the connection plug 10 may perform functions of at least two types of connection plugs, for example, as a universal serial bus (USB) port or an input and output port which inputs and outputs signals according to uses.

Referring to FIGS. 2 and 3, a case 11 may include a mounting case 110 to mount first plug connection terminals 20 and second plug connection terminals 30 which are different types from each other, and a cover case 120 to enclose the outside of the mounting case 110.

The mounting case 110 includes a first mounting portion 111 to mount the first plug connection terminals 20, a second mounting portion 113 to mount the second plug connection terminals 30, and a third mounting portion 115 to mount a circuit board 117.

The first mounting portion 111 may include first terminal mounting recesses 111*a* opened at an upper portion to mount the first plug connection terminals 20. The second mounting portion 113 may include second terminal mounting recesses 113*a* opened at an upper portion to mount the second plug connection terminals 30. Here, the first mounting portion 111 and the second mounting portion 113 may form one plane such that the first plug connection terminals 20 and the second plug connection terminals 30 are disposed on one plane. Thus, since the first and second plug connection terminals 20 and 30 are fixed to the first and second terminal mounting recesses 111*a* and 113*a* by a simple assembly method rather than conventional insert molding, the manufacturing process may be simplified.

Ends of the first plug connection terminals 20 and ends of the second plug connection terminals 30 to be inserted in the socket S may be disposed in different positions so that the respective plug connection terminals do not interfere with each other.

In detail, to perform different functions by being connected with connection terminals of the socket S, the first plug connection terminals 20 and the second plug connection terminals 30 should not interfere with each other when connected by the ends. Therefore, connection positions of the first plug connection terminals 20 and the second plug connection terminals 30 with respect to the connection terminals of the socket S may be different from each other.

For example, one end of each of the first plug connection terminals 20 may be disposed at a front side of the mounting case 110, that is, a side of the case 11 inserted in the socket S. The second plug connection terminals 30 may be disposed at a rear side of the mounting case 10 such that one end of each of the second plug connection terminals 30 are disposed at a rear side end of each of the first plug connection terminals 20. Therefore, the first and second plug connection terminals 20 and 30 and the connection terminals of the socket S may be connected from the front side and the rear side of the mounting case 110.

Here, the first plug connection terminals 20 and the second plug connection terminals 30 may have different lengths from each other. For example, the first plug connection terminals 20 may be formed relatively longer and disposed on both sides of the mounting case 110 whereas the second plug connection terminals 30 are formed shorter than the first plug connection terminals 20 and disposed between the respective first plug connection terminals 20. Presuming that the front side of the mounting case 110 refers to a side to be inserted in the socket S, the ends of the first plug connection terminals 20 may be disposed at the front side of the mounting case 110 while the ends of the second plug connection terminals 30 are disposed behind the ends of the first plug connection terminals 20.

Accordingly, when the connection plug 10 is inserted in the socket S, the first plug connection terminals 20 and the second plug connection terminals 30 are disposed on one plane. However, since the ends of the first plug connection terminals 20 and the ends of the second plug connection terminals 30 are disposed in different positions, that is, at the front side and the rear side, connection positions of the first plug connection terminals 20 and the second plug connection terminals 30 with respect to the socket S become different. As a result, interference may be prevented.

The terminal mounting recesses 111*a* and 113*a* of the mounting case 110 may be formed corresponding to the lengths of the first plug connection terminals 20 and the second plug connection terminals 30, respectively. The third mounting portion 115 may be integrally extended from one side of the first mounting portion 111 and the second mounting portion 113. The third mounting portion 115 may be formed in a box shape including first terminal through holes 111*b* and second terminal through holes 113*b* allowing passage of the rear ends of the first plug connection terminals 20 and the second plug connection terminals 30 respectively mounted in the first terminal mounting recesses 111*a* and the second terminal mounting recesses 113*a* of the first mounting portion 111 and the second mounting portion 113.

In addition, fixing projection mounting portions 131 are provided to the third mounting portion 115 to insert and fix case fixing projections 130 including projections projecting outward from both ends of the first mounting portion 111.

In addition, the third mounting portion 115 may include the circuit board 117 to be connected with the first plug connection terminals 20 and the second plug connection terminals 30. The circuit board 117 may receive and transmit electrical signals so that the plug connection terminals 20 and 30 may perform functions of a USB port or an input and output port through a circuit pattern.

When the ends of the first and second plug connection terminals 20 and 30 near the rear end are passed through the first and second terminal through holes 111*b* and 113*b* and exposed out of the third mounting portion 115, the circuit board 117 may be mounted by being inserted in the board mounting recess 117*a* depressed inward from a rear surface of the third mounting portion 115 having the box shape.

That is, the board mounting recess 117*a* may be formed at the third mounting portion 115. When the first and second plug connection terminals 20 and 30 are mounted in the first and second terminal mounting recesses 111*a* and 113*a* of the first and second mounting portions 111 and 113, simultaneously, the board mounting recess 117*a* may be connected with the circuit board 117. Therefore, a separate unit for connecting the first and second plug connection terminals 20 and 30 to the circuit board 117 is unnecessary. However, when a contact force with respect to the circuit board 117 is insufficient with only elastic force of the first and second plug connection terminals 20 and 30, soldering and the like may be applied for fixing.

The cover case 120 may enclose one side of the mounting case 110 to protect the first and second plug connection terminals 20 and 30. In addition, the cover case 120 may be opened to both sides to be connected with the respective connection terminals by being inserted in the socket S with one side.

The cover case 120 may include fixing projection insertion holes 135. The case fixing projections 130 formed at the fixing projection mounting portions 131 disposed on both sides of the mounting case 110 may be inserted in the fixing projection insertion holes 135 and protrude out of the cover case 120. As the connection plug 10 is inserted in the socket S, the case fixing projections 130 may be inserted in the socket S, thereby coupling the connection plug 10 with the socket S.

Additionally, a middle fixing projection 133 protrudes upward from an upper surface of the third mounting portion 115 of the mounting case 110. The cover case 120 may include a middle fixing hole 137 for insertion of the middle fixing projection 133. The middle fixing hole 137 of the cover case 120 may be disposed at a fixing piece 136 extending from an upper surface of the cover case 120.

Figure 4A:
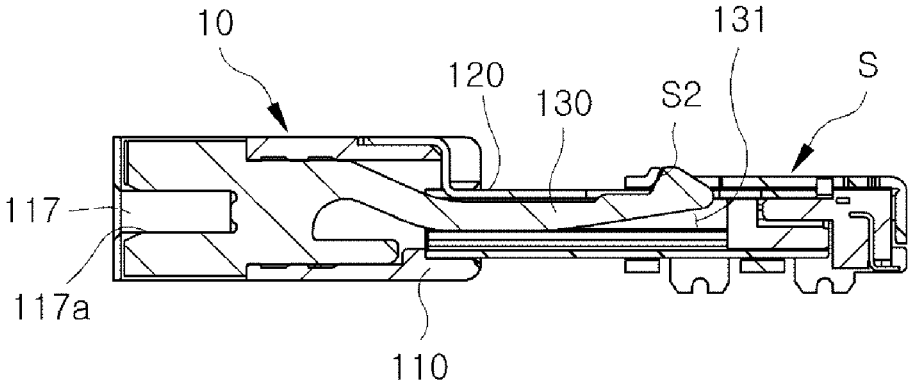
FIG. 4A is a diagram illustrating a state in which a case fixing projection is coupled with the socket when the connection plug for a portable terminal according to the present invention is inserted in the socket.
Figure 4B:
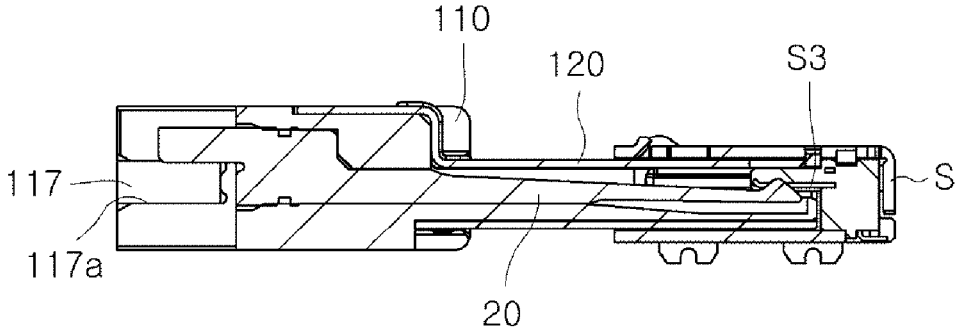
FIG. 4B is a diagram illustrating a state in which a first plug connection terminal is connected with connection terminals of the socket when the connection plug for a portable terminal according to the present invention is inserted in the socket.
Figure 4C:
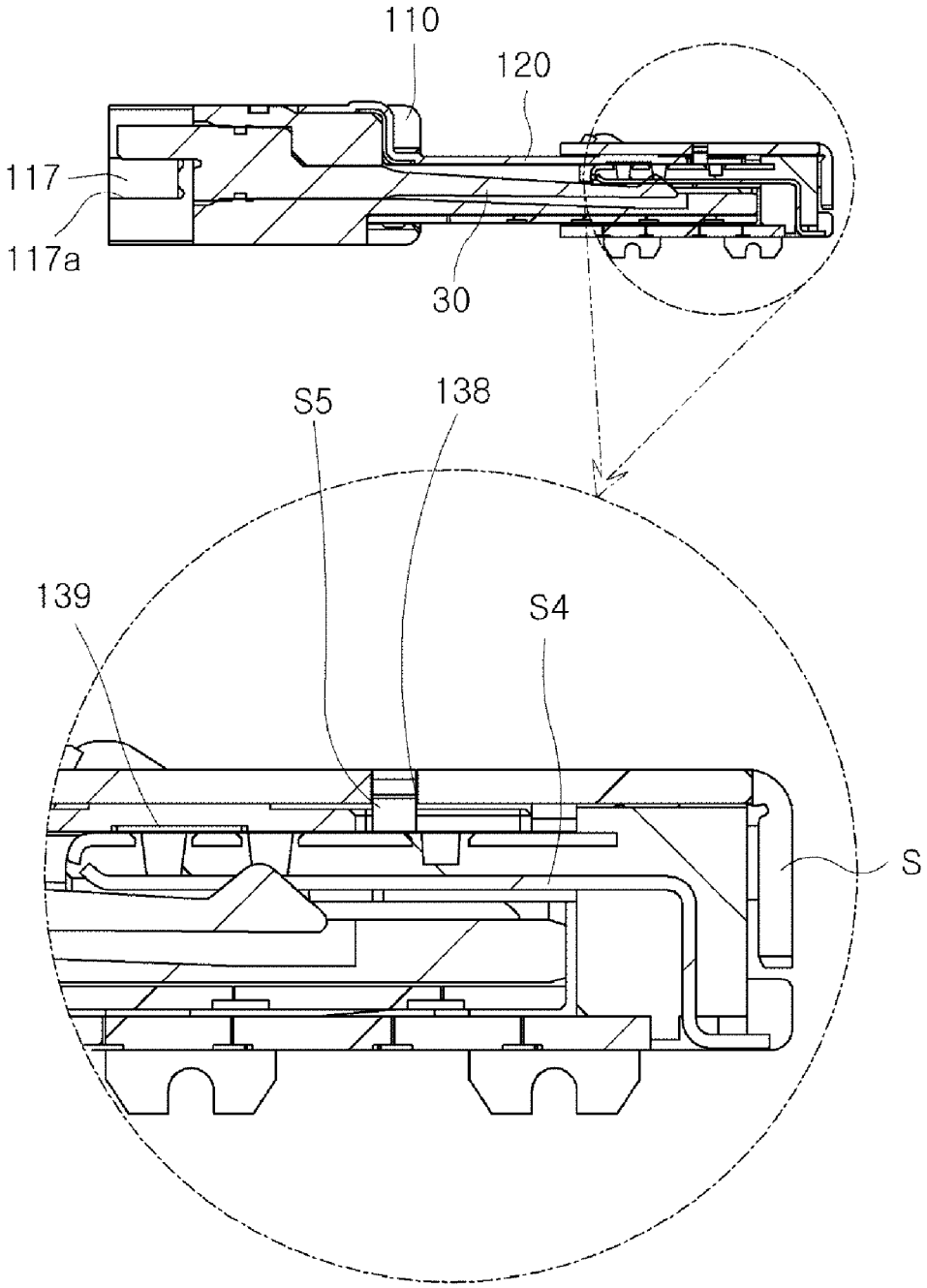
FIG. 4C is a diagram illustrating a state in which a second plug connection terminal is connected with the connection terminals of the socket when the connection plug for a portable terminal according to the present invention is inserted in the socket.
Figure 5:
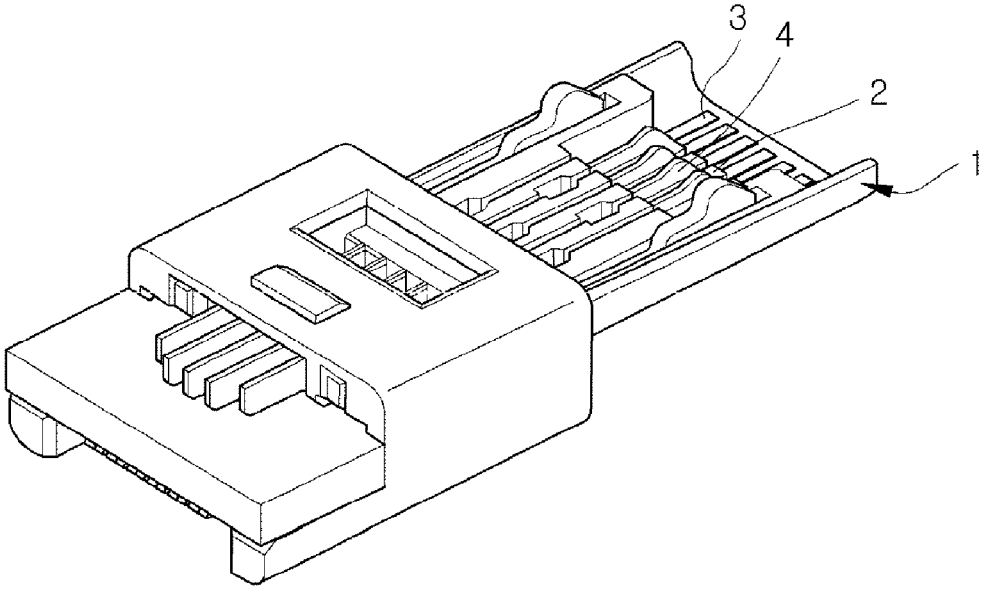
FIG. 5 is a diagram illustrating a part of a connection plug for a portable terminal according to a conventional art.

As shown in FIGS. 2 and 4C, the cover case 120 may include a stopper insertion hole 138 disposed at an end surface opened to insert a plug stopper S5 of the socket S as the connection plug 10 is inserted in the socket S. The stopper insertion hole 138 may include an insertion guide surface 138*a* to guide insertion of the cover case 120 into the socket S by contacting the plug stopper S5 formed at the socket S, and a stopper surface 138*b* to stop the connection plug P from being inserted into the socket S more than a proper degree by contacting the plug stopper S5 being inserted along the insertion guide surface 138*a*.

When the connection plug 10 is not sufficiently inserted in the socket S, the first and second connection terminals 20 and 30 of the connection plug 10 may not be connected with the connection terminals of the socket S. When the connection plug 10 is excessively inserted in the socket S, the first and second connection terminals 20 and 30 and the connection terminals of the socket S may interfere with each other.

Although not shown, when the cover case 120 is inserted in the socket S, the stopper insertion hole 138 may guide the plug stopper S5 formed at the socket S along the insertion guide surface 138*a* so that the connection plug 10 and the connection terminals of the socket S are correctly connected. Simultaneously, the stopper insertion hole 138 may prevent the connection plug 10 from being further inserted in the socket S as the plug stopper S5 comes into contact with the stopper surface 138*b*.

The stopper insertion hole 138 may be disposed in a position where the plug stopper S5 of the socket S is inserted and may be provided on any one or both of an upper surface and a lower surface of the cover case 120.

The cover case 120 may further include a fixing projection 139 protruding upward from the upper surface. The fixing projection 139 may minimize a gap between the cover case 120 and the socket S when the connection plug P is inserted in the socket S, thereby preventing separation between the socket S in a connected state and the connection plug 10.

FIG. 4A is a diagram illustrating a state in which the case fixing projections 130 are coupled with the socket S when the connection plug 10 for a portable terminal according to the present invention is inserted in the socket S. FIG. 4B is a diagram illustrating a state in which a first plug connection terminal is connected with the connection terminals of the socket S when the connection plug 10 for a portable terminal according to the present invention is inserted in the socket. FIG. 4C is a diagram illustrating a state in which a second plug connection terminal is connected with connection terminals of the socket when the connection plug 10 for a portable terminal according to the present invention is inserted in the socket.

Hereinafter, the process for the connection plug 10 to be connected with the socket S and the connected state will be described in detail with reference to the drawings.

The connection plug 10 is inserted in the socket S mounted on the circuit board C.

Therefore, the case fixing projections 130 disposed at the fixing projection mounting portion 131 of the mounting case 110 may be inserted in a coupling hole S2 formed at the socket S, as shown in FIG. 4A. The case fixing projections 130 inserted in the coupling hole S2 may prevent the connection plug 10 from escaping the socket S while guiding the connection plug 10 to an insertion position in the socket S.

As shown in FIG. 4B, the first plug connection terminals 20 are connected with a first connection terminal S3 mounted at the socket S. Since the first plug connection terminals 20 are longer than the second plug connection terminals 30, the ends of the first plug connection terminals 20 are disposed at the front side of the mounting case 110 and connected with the first connection terminal S3 of the socket S at the front side of the mounting case 110.

Simultaneously, as shown in FIG. 4C, the second plug connection terminals 30 are connected with a second connection terminal S4 mounted at the socket S. Since the second plug connection terminals 30 are shorter than the first plug connection terminals 20, connection positions of the second plug connection terminals 30 with respect to the second connection terminal S4 are disposed at the rear side of the mounting case 110. Accordingly, interference with the first plug connection terminals 20 and the first connection terminal S3 of the socket S may be prevented.

That is, while the first and second connection terminals S3 and S4 of the socket S are arranged on one plane, the first connection terminal S3 is formed relatively shorter for connection with the ends of the first plug connection terminals 20 which are relatively longer, and the second connection terminal S4 is formed relatively longer for connection with the ends of the second plug connection terminals 30 which are relatively shorter.

Therefore, connection between the first plug connection terminals 20 and the first connection terminal S3 is performed at the front side of the mounting case 110 whereas connection between the second plug connection terminals 30 and the second connection terminal S4 is performed at the rear side of the mounting case 110. Thus, interference may be prevented.

Here, the connection plug 10 may be inserted in the socket S in such a manner that the insertion guide projection S5 formed at the socket S is inserted in the insertion guide hole 138 of the cover case 120. The insertion guide hole 138 may have a length corresponding to an insertion length of the connection plug 10 into the socket S. In this case, since excessive insertion of the connection plug 10 into the socket S is prevented, the second plug connection terminals 30 which are short may be prevented from being connected with the first connection terminal S3 scheduled to be connected with the first plug connection terminals 20 which are long. Also, insufficient insertion of the connection plug 10 into the socket S is prevented, thereby preventing failure in connection between the connection plug 10 and the first and second connection terminals S3 and S4.

Therefore, the connection plug 10 may be inserted in the socket S such that the insertion guide hole 138 is engaged with the insertion guide projection S5 of the socket S, so that the first and second plug connection terminals 20 and 30 are stably connected with the first and second connection terminals S3 and S4 without causing any interference.

Furthermore, when the connection plug 10 is inserted in the socket S, the fixing projection 139 formed at the upper surface of the cover case 120 may minimize the gap between the connection plug 10 and the socket S by contacting an inner surface of the socket S. Accordingly, unwanted separation of the connection plug 10 from the socket S may be prevented.

Accordingly, the connection plug for a portable terminal according to the present invention may be configured such that at least two different plug connection terminals are arranged on one plane and connection terminals of a socket are disposed in different positions. As a result, an entire thickness of the connection plug may be minimized.

Although a few exemplary embodiments of the present invention have been shown and described, the present invention is not limited to the described exemplary embodiments. Instead, it would be appreciated by those skilled in the art that changes may be made to these exemplary embodiments without departing from the principles and spirit of the invention, the scope of which is defined by the claims and their equivalents.

What is claimed is:

1. A connection plug for a portable terminal, comprising:

a case having:

(a) a mounting case having:

(1) a first mounting portion and a second mounting portion formed corresponding to lengths of plug connection terminals, and (2) a third mounting portion at the rear ends of the first mounting portion and the second mounting portion wherein the third mounting portion comprises board mounting recesses to insert both ends of a circuit board connected with the plug connection terminals passing through the third mounting portion; and (b) a cover case configured to protect the plug connection terminals by enclosing the mounting case and coupled to the mounting case by the third mounting portion;

and a plurality of the plug connection terminals of different types having ends disposed on one plane in the case and adapted to be inserted in a socket for connection with connection terminals in the socket at different positions.

2. The connection plug of claim 1, wherein the plurality of plug connection terminals are in different lengths.

3. The connection plug of claim 1, wherein the cover case comprises a fixing projection that protrudes upward from an upper surface of the cover case so that the fixing projection contacts an inner surface of the socket when inserted in the socket.

4. The connection plug of claim 1, wherein the connection plug is engaged with the socket by the plug connection terminals, the socket comprising the connection terminals arranged on one plane.

5. The connection plug of claim 1, wherein the mounting case is configured so that the plug connection terminals are attached to or separated from the mounting case.

6. The connection plug of claim 5, wherein the plurality of plug connection terminals include a plurality of first type plug connection terminals and a plurality of second type plug connection terminals and the mounting case comprises:

(a) the first mounting portion to mount the first type plug connection terminals; and (b) the second mounting portion to mount the second type plug connection terminals.

7. The connection plug of claim 6, wherein the first type plug connection terminals are longer than the second type plug connection terminals.

8. The connection plug of claim 6, wherein the first type plug connection terminals are disposed along both sides of the second plug connection terminals.

9. The connection plug of claim 1, wherein:

(a) the socket comprises a plug stopper to restrict an insertion length of the cover case with respect to the socket, and (b) the cover case comprises a stopper insertion hole to insert the plug stopper and restrict the insertion length of the cover case with respect to the socket as the plug stopper contacts the cover case.

10. The connection plug of claim 9, wherein the stopper insertion hole is formed having a length corresponding to a length of the case to be inserted in the socket so that the plug connection terminals are respectively connected to the connection terminals of the socket.

11. A connection plug for a portable terminal comprising: a case having:

(a) a mounting case having:

(1) a first mounting portion and a second mounting portion formed corresponding to lengths of first type plug connection terminal and second type plug connection terminal, respectively, and (2) a third mounting portion at the rear ends of the first mounting portion and the second mounting portion; and (b) a cover case configured to protect the first type plug connection terminal and the second type plug connection terminal by enclosing the mounting case and coupled to the mounting case by the third mounting portion, wherein the third mounting portion comprises board mounting recesses to insert both ends of a circuit board connected with the first type plug connection terminal and the second type plug connection terminal passing through the third mounting portion;

the first type of plug connection terminal:

(a) disposed in the case on a plane with an end of the first type of plug connection terminal at a first position, and (b) adapted to be inserted in a socket for connection with a first connection terminal in the socket at the end of the first type plug connection terminal; and the second type of plug connection terminal:

(a) disposed in the case on the same plane as the first type plug connection terminal with an end of the second type plug connection terminal at a second position different from the position of the end of the first type plug connection terminal, and (b) adapted to be inserted in the socket for connection with a second connection terminal in the socket at the end of second type plug connection terminal.

12. The connection plug of claim 11, wherein the cover case comprises a fixing projection that protrudes upward from an upper surface of the cover case so that the fixing projection contacts an inner surface of the socket when inserted in the socket.

13. The connection plug of claim 11, wherein the length of the first type plug connection terminal is different from the length of the second type plug connection terminal.

14. The connection plug of claim 13, wherein the mounting case is:

(a) configured so that the first type plug connection terminal and the second type plug connection terminal are attached to or separated from the mounting case, and (b) comprising:

(1) the first mounting portion to mount the first type plug connection terminal, and (2) the second mounting portion to mount the second type plug connection terminal.

15. The connection plug of claim 11, wherein:

(a) the socket comprises a plug stopper to restrict an insertion length of the cover case with respect to the socket, and (b) the cover case comprises a stopper insertion hole to insert the plug stopper and restrict the insertion length of the cover case with respect to the socket as the plug stopper contacts the cover case.

16. The connection plug of claim 15, wherein the stopper insertion hole is formed having a length corresponding to a length of the case to be inserted in the socket so that the first type plug connection terminal and the second type plug connection terminal are respectively connected to the connection terminals of the socket.

* * * * *